United States Patent [19]

Luciani

[11] Patent Number: 4,841,423

[45] Date of Patent: Jun. 20, 1989

[54] ADDITIONAL HEADLIGHT FOR USE ON A MOTOR VEHICLE IN CONJUNCTION WITH A DIPPED HEADLIGHT

[75] Inventor: Bernard Luciani, Paris, France

[73] Assignee: Cibie Projecteurs, Bobigny Cedex, France

[21] Appl. No.: 62,214

[22] Filed: Jun. 15, 1987

[30] Foreign Application Priority Data

Jun. 17, 1986 [FR] France ..... 86 08722

[51] Int. Cl.[4] ..... F21V 7/09

[52] U.S. Cl. ..... 362/304; 362/61; 362/297; 362/346

[58] Field of Search ..... 362/61, 80, 236, 238, 362/297, 304, 307, 309, 346

[56] References Cited

U.S. PATENT DOCUMENTS

| | | | |
|---|---|---|---|
| 3,062,951 | 11/1962 | Falge | 362/211 |
| 4,428,038 | 1/1984 | Rakitsch et al. | 362/263 |
| 4,530,042 | 7/1985 | Cibié et al. | 362/309 |
| 4,612,608 | 9/1986 | Peitz | 362/297 |

FOREIGN PATENT DOCUMENTS

| | | | |
|---|---|---|---|
| 75786 | 4/1983 | European Pat. Off. | 362/346 |
| 1393430 | 2/1965 | France . | |

OTHER PUBLICATIONS

Halliday et al., *Fundamentals of Physics*, ©1970, 1974, Wiley & Sons, p. 684.

*Primary Examiner*—Albert J. Makay
*Assistant Examiner*—Allen J. Flanigan

[57] ABSTRACT

A motor vehicle headlight suitable for emitting a light beam which is essentially complementary to a dipped beam having a cut-off so that together the two beams constitute a main beam, the headlight being of the type comprising an axial filament lamp (100), a reflector (200), and a closure glass (300), the headlight including the improvement whereby: the filament of the lamp emits freely in all directions thereabout; the reflector comprises two first sectors which are paraboloid in shape, which have a common focus ($F_O$) situtated approximately in the middle (in the axial direction) of the filament, which are delimited by half-planes that are inclined on either side of a horizontal plane passing through the axis of the headlight in order to create a spot of light concentration in the vicinity of the headlight axis, and two other sectors which interconnect said first sectors and which are shaped such that the major part of each filament image produced thereby lies above a cutoff that substantially co-incides with the cutoff of the dipped beam; and certain zones of the closure glass include means for distributing the beam horizontally.

6 Claims, 5 Drawing Sheets

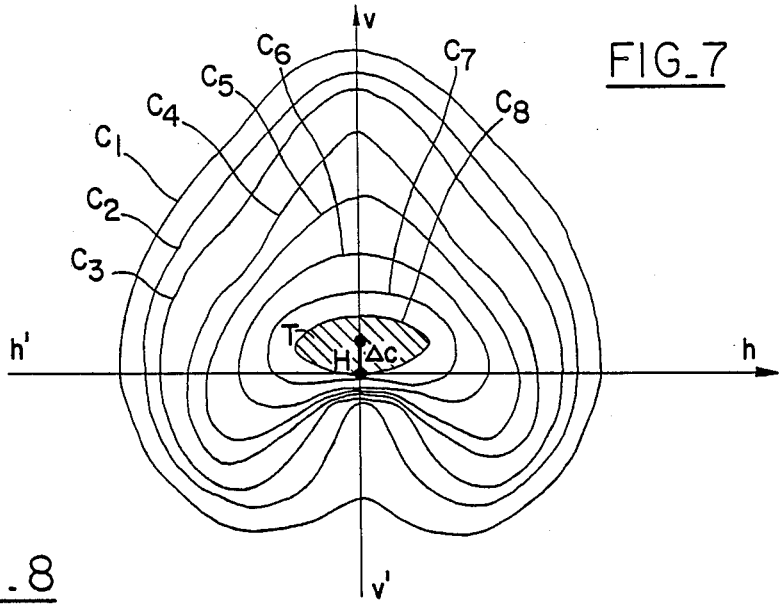
FIG_7
FIG_8
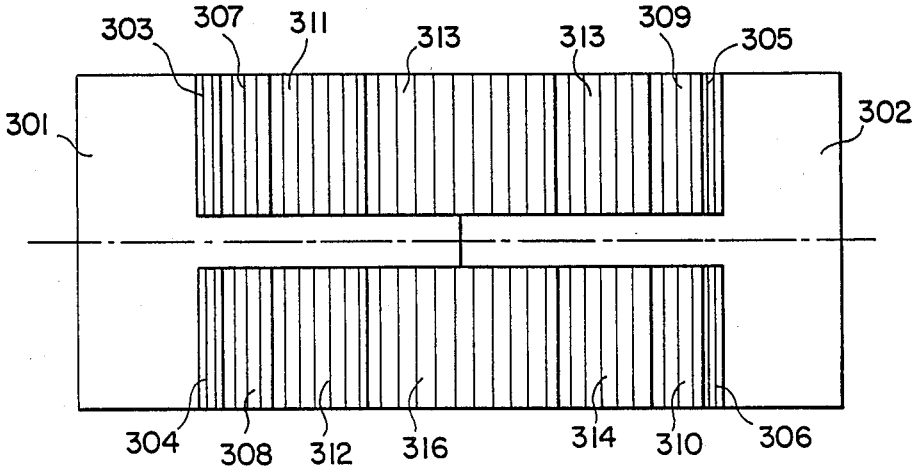
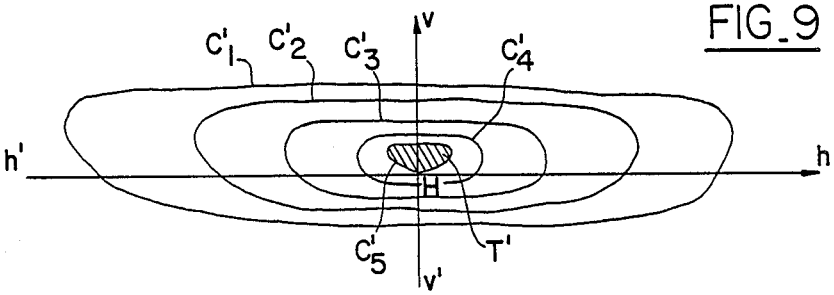
FIG_9

ADDITIONAL HEADLIGHT FOR USE ON A MOTOR VEHICLE IN CONJUNCTION WITH A DIPPED HEADLIGHT

The present invention relates to an additional headlight for a motor vehicle and suitable for providing a light beam such, that when juxtaposed with a dipped beam, the resulting combined beam meets the illumination standards appropriate for main beams.

BACKGROUND OF THE INVENTION

Some regulations, and in particular the European regulations, specify that a main beam shall comply with a well-determined photometric pattern, without putting any particular constraints on how such a beam is to be obtained. Thus, a main beam may be established, whenever required by a driver, by leaving the dipper beam headlight on and by juxtaposing a beam additional to the dipped beam, with said additional beam being substantially complementary to the dipped beam and being provided by an additional headlight.

A specific advantage of this type of solution is that during night driving the dipped beam headlight remains switched on permanently, thereby reducing fatigue in its filament and the inevitable loss of lifetime associated with such fatigue, with such fatigue normally arising because it is conventional practice for the dipped beam headlight to be switched off each time the main beam is switched on, and vice versa.

In addition, a considerable increase in light intensity is obtained since the power available from two lamps is being summed.

French patent 1 393 430 describes several embodiments of additional headlights of this type. In each of these embodiments, there is an axial filament lamp, a reflector, and a closure glass, optionally accompanied by masking elements for masking certain determined regions of the light flux emitted by the filament. The specific design of the filament, of the masking elements, and of the vertical deflection strips provided on the closure glass serves to obtain a beam which is effectively essentially complementary to a European type dipped beam (as recalled below).

However, regardless of the way in which it is embodied in practice, an additional headlight of this type suffers from at least one of the following considerable drawbacks:

the reflector includes surface discontinuities and is therefore difficult to manufacture using up to date techniques such as injection molding;

the masking elements which intercept a portion of the light flux emitted by the filament reduce the useful light yield from the additional headlight; and the closure glass is required to deflect rays vertically through a considerable angle by means of its in-built prisms, thereby giving rise to excess glass thickness making the glass difficult to manufacture, and also giving rise to optical defects due to the considerable steps or undercuts in the surface of the glass.

Preferred embodiments of the present invention mitigate or eliminate these drawbacks of prior art additional headlights, and seek, in particular, to provide an additional headlight which does not include a masking element for masking the light flux emitted by the filament, thereby increasing the resulting light yield, whose closure glass has deflector prisms essentially solely for obtaining small horizontal deflection of a determined portion of the light rays, and, at least in some embodiments, whose reflector is easy to make by molding.

SUMMARY OF THE INVENTION

The present invention provides a motor vehicle headlight suitable for emitting a light beam which is essentially complementary to a dipped beam having a cut-off so that together the two beams constitute a main beam, the headlight being of the type comprising an axial filament lamp, a reflector, and a closure glass, the headlight including the improvement whereby:

the filament of the lamp emits freely in all directions thereabout;

the reflector comprises two first sectors which are paraboloid in shape, which have a common focus situated approximately in the middle (in the axial direction) of the filament, which are delimited by half-planes that are inclined on either side of a horizontal plane passing through the axis of the headlight in order to create a spot of light concentration in the vicinity of the headlight axis, and two other sectors which interconnect said first sectors and which are shaped such that the major part of each filament image produced thereby lies above a cutoff that substantially co-incides with the cut-off of the dipped beam; and certain zones of the closure glass include means for distributing the beam horizontally.

BRIEF DESCRIPTION OF THE DRAWINGS

Preferred embodiments of the invention are described by way of example with reference to the accompanying drawings, in which:

FIG. 7 is a plot of isocandela curves on a projection screen representative of the illumination provided by the additional headlight shown in FIGS. 2 and 3 without its closure glass;

FIG. 8 is a back view of a closure glass specially designed for the headlight of FIGS. 2 and 3;

FIG. 9 is a plot of isocandela curves on a projection screen representative of the illumination provided by the additional headlight of FIGS. 2 and 3 when fitted with its closure glass;

DESCRIPTION OF PREFERRED EMBODIMENTS

Figure 1:
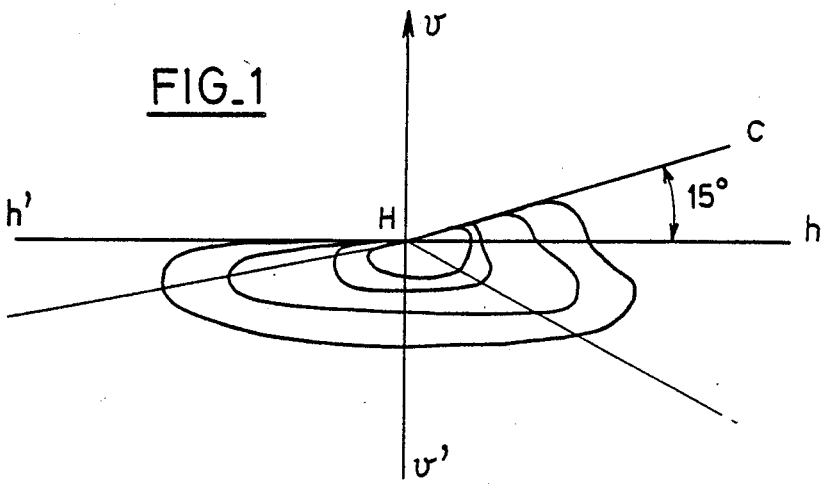
FIG. 1 is a front view of a dipped beam in compliance with European regulations and projected onto a standard screen at a distance of 25 meters.

With reference to the drawings, FIG. 1 shows the illumination provided by a dipped headlight beam when projected onto a standardized screen at 25 meters. In particular, it shows the cutoff h'Hc as required by the regulations applicable in several European countries.

The aim of the invention is to define an additional headlight capable of providing a beam which is essentially complementary to said dipped beam, i.e. a beam which is situated, for the most part, above the cufoff of the dipped beam.

More generally, the invention relates to an additional headlight whose reflector is suitable for projecting images of its axial filament so that they all lie substantially on or above the horizontal line h'Hh.

Figure 2:
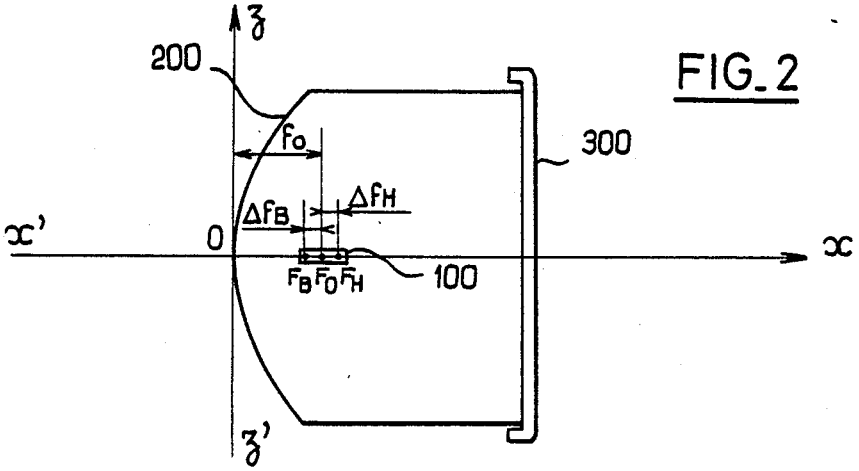
FIG. 2 is a diagrammatic longitudinal vertical section through an additional headlight in accordance with a first embodiment of the present invention.
Figure 3:
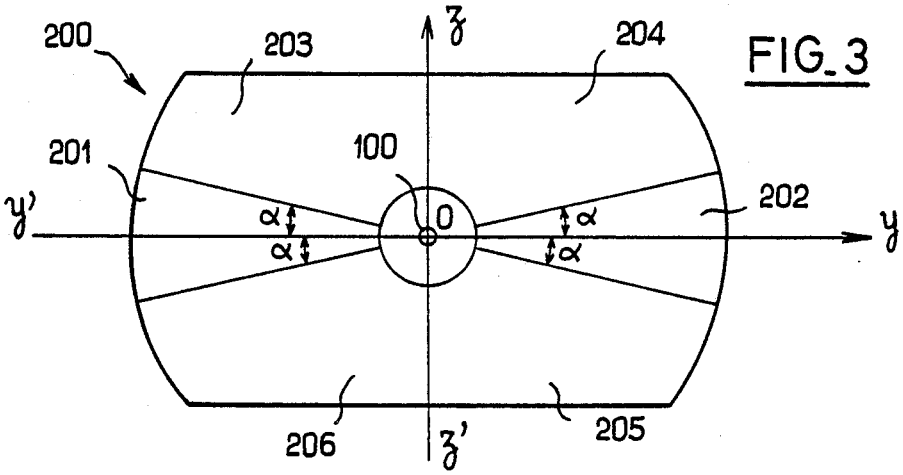
FIG. 3 is a rear view of the FIG. 2 headlight.

One example of such a headlight is shown diagrammatically in FIGS. 2 and 3. It comprises a lamp having a cylindrical filament 100 disposed axially, a reflector or mirror 200, and a closure glass 300. The filament 100 is not associated with a masking cup of the kind generally provided when a beam delimited by a given cutoff is to be created. The filament therefore emits freely in all directions thereabout.

FIGS. 2 and 3 show the filament 100 disposed in such a manner that its axis lies along the axis Ox of the reflector, and the following description refers to that particular disposition.

However, in practice (but not shown) it may be desirable to make a dipped beam headight and an additional headlight in accordance with the invention in such a manner that their reflectors are made as a single part, e.g. in a single molding operation.

Unfortunately, the axis of a dipped beam headlight is often tilted below the horizontal by 1% (i.e. at a slope of 1 in 100). Thus, in order to avoid difficulties associated with unmolding such a two-mirror reflector, it is desirable for the axis of the additional projector to be tilted by the same amount. In which case, in accordance with the present invention, the filament 100 should be offset a little way downwardly in order to move all the images it projects back up, thereby compensating the downward shift due to the headlight axis being tilted. In any event, the filament axis should remain parallel to the reflector axis.

However, the considerations given below, in particular concerning the special geometry of the reflector, remain valid regardless of the configuration used, and in particular regardless of the vertical offset between the filament axis and the axis of the reflector.

The reflector 200 is designed from the geometrical point of view so that all of the images which it creates of the filament are situated either in the vicinity of the headlight axis, i.e. in the vicinity of the point H defined by the intersection of said headlight axis with the screen (i.e. the reference center point of the screen) or else above a horizontal cutoff defined by the horizontal h'Hh, which cutoff lies above the major portion of the light concentration obtained with a dipped beam. (The 15° slope of the right-hand half Hc of the cutoff is ignored in this case).

To this end, the reflector comprises two first sectors 201 and 202 for creating a concentration of filament images in the vicinity of the screen center H. These sectors are disposed symmetrically on either side of the axis Ox of the reflector, with O representing the apex of said reflector, and with the sectors being delimited by two inclined planes at the same angle $\alpha$ on either side of the horizontal plane xOy about the axis Ox. This angle $\alpha$ is preferably less than 45°, and has in the present embodiment a value of about 12.5°.

Each sector 201 and 202 is in the form of a portion of a paraboloid having its focus $F_0$ (see FIG. 2) situated in the middle (in the axial direction) of the filament 100. These sectors thus satisfy the equation:

$$x = \frac{y^2}{4f_0} + \frac{z^2}{4f_0}$$

where $F_0$ is the focal length of these two paraboloid portions and corresponds to the focus $F_0$ shown in FIG. 2, i.e. is chosen to be equal to the distance between the origin O and the center of the filament 100.

Figure 4:
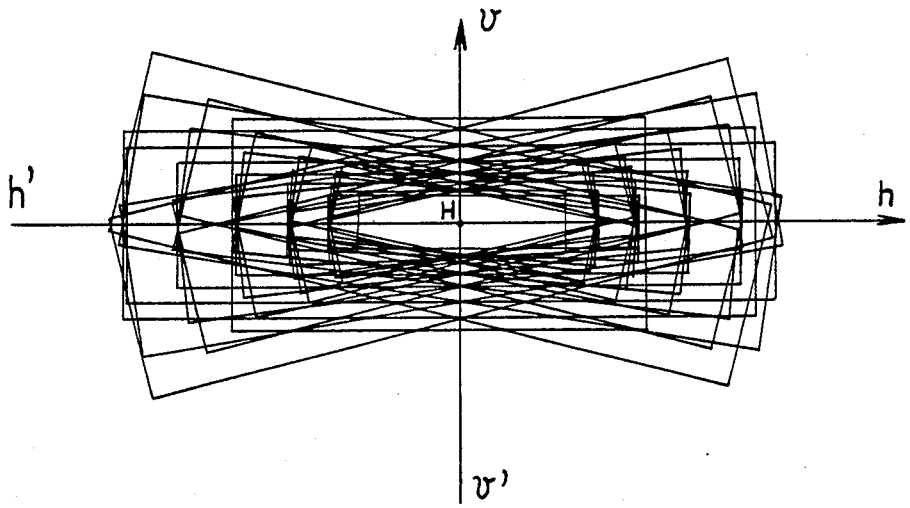
FIGS. 4 to 6 are views of filament images obtained from three respective determined portions of the reflector as projected onto the standardized screen at 25 meters.

FIG. 4 is a plot on a standardized screen at 25 meters of the filament images as projected by these first sectors of the reflector 200. As can be seen, a concentration spot (a superposition of the largest number of images) is obtained in the region of the center H, and said images are all at angles lying in the range $-\alpha$ to $+\alpha$ relative to the horizontal h'Hh.

The reflector 200 also includes four other sectors 203 to 206 which are grouped in pairs respectively in the top half and the bottom half of the reflector. The shapes of these sectors are defined accurately by a mathematical approach below, the are designed to project filament images on the screen such that all said images have their centers situated above the horizontal h'Hh.

The shapes of these other sectors are also designed, in this first embodiment, so that the surface of the reflector is substantially free from discontinuities.

In this specification, the term "free from discontinuities" is used to indicate that second order continuity is ensured at all points on the surface (other than at two localized continuity defects, as explained below), i.e. that at any point along any line belonging to the surface, the tangent planes are the same on either side of said line. In practice, this disposition ensures that the real surfaces obtained are a very close match to the theoretical or design surfaces, and in particular the defects associated with offset paraboloids as described in above-mentioned French patent specification number 1 393 430 are avoided.

More precisely, theoretical calculation shows the surfaces having the specified properties have the following equations:

for the sectors 203 and 204 extending between the sectors 201 and 202 round the top half of the reflector:

$$x = \frac{(y\cos\alpha + z(y/|y|)\sin\alpha)^2}{4f_0} + \frac{(z\cos\alpha - |y|\sin\alpha)^2}{4(f_0 + \Delta f_H/P)}$$

with:

$$P = 1 + \frac{(y\cos\alpha + z(y/|y|)\sin\alpha)^2}{4f_0^2}$$

In this equation $\alpha$ and $f_0$ are as defined above, and $\Delta f_H$ is a parameter explained in greater detail below which determines for each filament image the respective offset APH between the centers C of this image and the center H of the standardized screen (see FIG. 5). This parameter is preferably less than half the length of the filament 100.

For the sectors 205 and 206 which extend between the sectors 201 and 202 round the bottom half of the reflector, the equation is as follows:

$$x = \frac{(y\cos\alpha - z(y/|y|)\sin\alpha)^2}{4f_0} + \frac{(-z\cos\alpha - |y|\sin\alpha)^2}{4(f_0 - \Delta f_B/Q)}$$

with:

-continued $$Q = 1 + \frac{(y\cos\alpha - z(y/|y|)\sin\alpha)^2}{4f_0^2}$$

As above, $\Delta f_B$ is a parameter which determines the respective offset between the center C of each image and the center H of the standardized screen, and it is preferably approximately equal to $\Delta f_H$. Parameter $\Delta f_H$ determines the offsets of the filament images generated by the upper portion of the reflector and $\Delta f_B$ determines the offsets of the filament images generated by the lower portion of the reflector.

Figure 5:
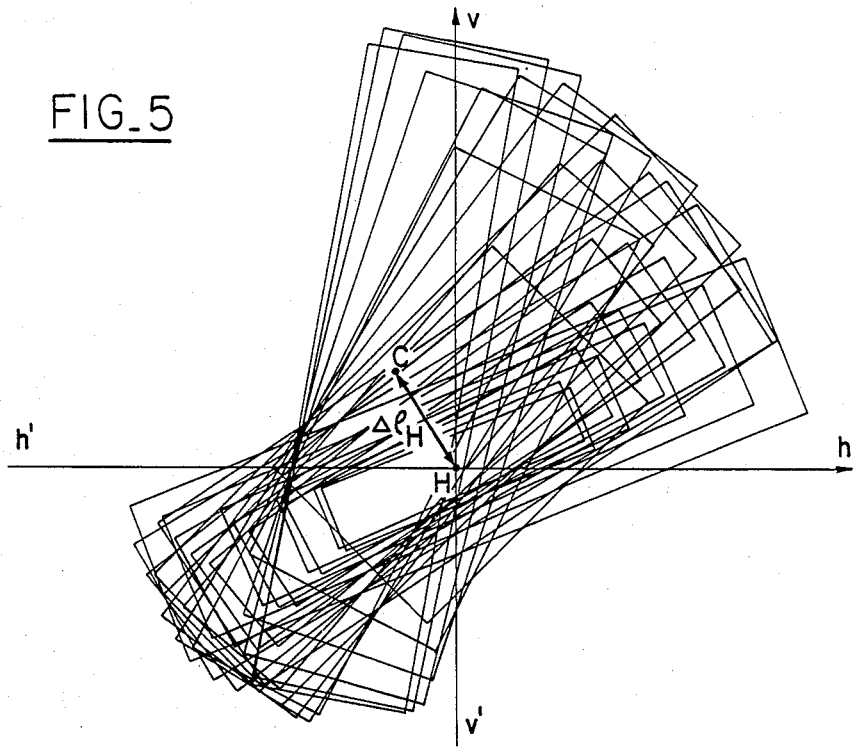
Figure 6:
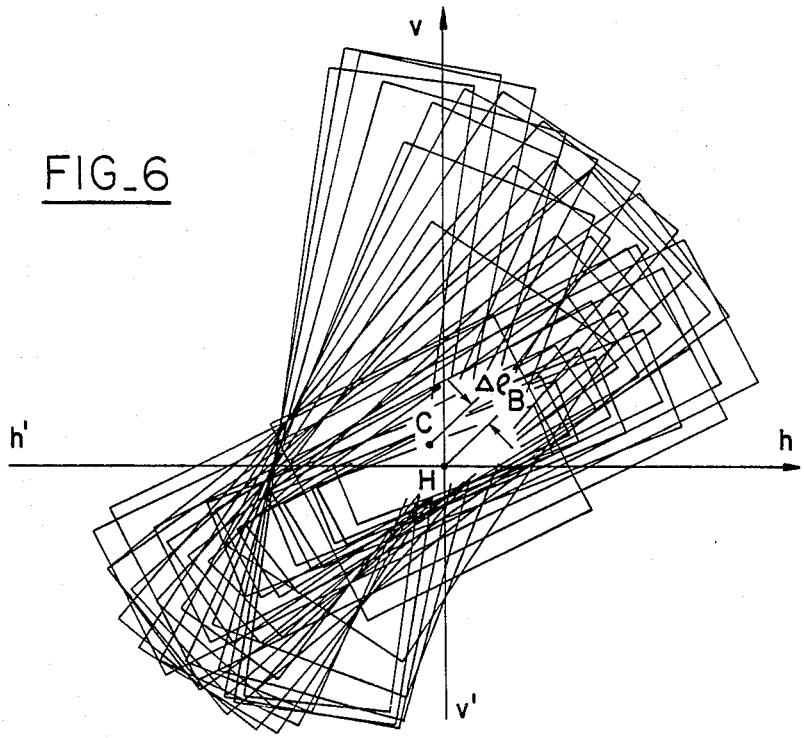

FIGS. 5 and 6 are views of the standardized screen at 25 meters showing the images of a center filament as projected respectively by the sectors 203 and 205 as defined mathematically above. As can be seen, the centers of these filament images are all displaced from H through respective offsets $\Delta\rho_H$, $\Delta\rho_B$ and thus define a concentration spot which is displaced slightly above said horizontal line through an offset $\Delta c$ (see FIG. 7) which is approximately equal to the average of the vertical components of each individual offset $\Delta\rho_H$ and $\Delta\rho_B$. It will be understood that the images provided by the sectors 204 and 206 are symmetrical to the images provided by the sectors 203 and 205 respectively about a vertical plane v'Hv. They are therefore not shown.

The parameters $\alpha$ $\Delta f_H$ and $\Delta f_B$ which appear in the above equations have the following effects on the illumination obtained.

Firstly, if the angle $\alpha$ is changed, the limiting slopes of the images centered on the point H from the sectors 201 and 202 of the reflector are caused to vary. Thus, the smaller the angle $\alpha$, the flatter the images, and vice versa. However, it should be observed that the light intensity (or the number of images) of the concentration spot obtained from the sectors 201 and 202 is proportional to the area of said sectors, and thus to the value of the angle $\alpha$. Thus, it should not be too small. Inversely, the greater the value of the angle $\alpha$ the greater the maximum inclination of the filament images relative to the horizontal, thereby giving rise to a proportional increase in the number of images whose bottom points are well below the horizontal axis. This is not desirable since it degrades the complementary nature of the resulting beam.

In practice, the angle $\alpha$ is selected to provide the best compromise between the above conflicting trends, and depending on the requirements of any given case.

The parameters $\Delta f_H$ and $\Delta f_B$ may be equal to each other and are used for controlling the manner in which the images spread above the horizontal axis as shown in FIGS. 5 and 6. Thus, it will be understood that the centers C of the filament images from the corresponding reflector zones move farther away from the screen center H as one or other of these parameters increases. This disadvantageously reduces the light intensity created by said zones on the road axis.

At the same time, by increasing the values of these parameters the number of filament images having bottom regions below the horizontal plane is advantageously reduced. Here again, $\Delta f_H$ and $\Delta f_B$ are selected by finding a satisfactory compromise between the light intensity on the road axis and the number of images which extend below the horizontal plane.

It can be shown by relatively complex calculations which need not be reproduced herein that the surface of the above-defined reflector is second order continuous except for two regions defined by the intersection of the reflector with the vertical plane xOz, i.e. the regions which correspond to the junctions between the sectors 203 and 204 and between the sectors 205 and 206, respectively.

Thus, there remains a slight kink in each of these regions. Such a localized defect could theoretically be eliminated by a more complex mathematical definition of the surfaces of the sectors 203 to 206, but in practice it is easily eliminated during the polishing or finishing stages as applied to the reflector or to its mold.

The optical effects of such surface imperfections are negligible, in practice.

Reference is now made to FIGS. 7 to 9. The headlight illumination curves shown in FIGS. 7 and 9 are not obtained with a headlight structure as shown in FIGS. 2 and 3, but with a headlight whose filament is offset vertically downwardly, as mentioned above, but the headlight assembly (or at least the lamp-reflector assembly) has not yet been tilted downwardly.

Thus, FIG. 7 shows a set of isocandela curves $C_n$ on the projection screen of the illumination provided by a lamp whose filament is offset and by a reflector 200 without its closure glass. The values of the isocandela curves decrease going outwardly from the center of the spot.

A concentration spot (shaded zone T) is observed just above the horizontal line h'Hh, and the illumination is uniformly spread horizontally. There is a relatively sharp cutoff in the beam immediately below the concentration spot T as shown by the isocandela curves $C_n$ coming close together. Thus, it will be understood that when the beam is tilted downwardly when mounting the headlight on a vehicle in order to center the concentration spot T approximately on the point H and after the beam has been spread horizontally by the closure glass (as described below), a beam is obtained which is essentially complementary to the a dipped beam as shown diagrammatically in FIG. 1.

The filament offset and the headlight inclination can be given figures as follows. For $f_0$ having a value of about 22.5 mm, and for the reflector axis having the same slope as an associated dipped beam headlight, i.e. 1%, it appears that a downwards offset of the filament by about 0.5 mm is appropriate, given that the focus $F_0$ remains vertically above the center of the filament.

FIG. 8 is a back view of the preferred closure glass for an additional headlight in accordance with the invention regardless of whether it has a central filament or an offset filament.

The closure glass 300 is divided into 16 zones 301 to 316 disposed as shown, which disposition should be considered as being included in the present description.

The zones 301 and 302 whose areas correspond to a large extent with the sectors 201 and 202 of the reflector are left smooth so that they do not deflect light or so that they give rise to relatively little deflection, thereby retaining substantially intact the light concentration spot obtained from said sectors in the manner described above. This retains a light peak directed towards the horizontal providing the desired visual comfort in conventional manner for a main beam.

The zones 303 to 314 act mainly on the sloping filament images and comprise ribs or the like for applying a slight horizontal deflection to the light rays passing therethrough. This serves to provide a fairly wide region of average illumination around the above-described light peak.

Finally, the zones 315 and 316 are highly deflecting zones in order to provide a wide beam while operating on filament images which are fairly vertical.

FIG. 9 is a plot of isocandela curves C'n whose values decrease when going outwardly from the center, showing the illumination provided by the above-described headlight when fitted with the FIG. 8 closure glass. The presence of the light peak (spot T') prior to downward tilting can be seen, as can the very wide complementary beam obtained in this way.

Figure 10:
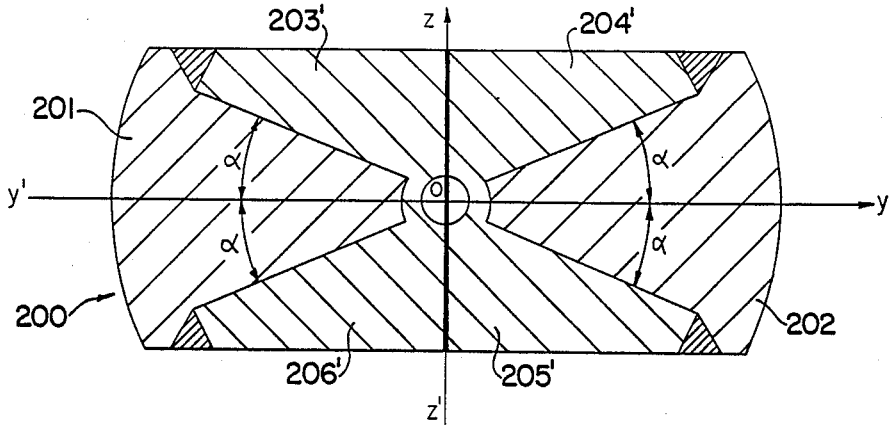
FIG. 10 is a back view of the reflector of a variant headlight in accordance with the invention.
Figure 11:
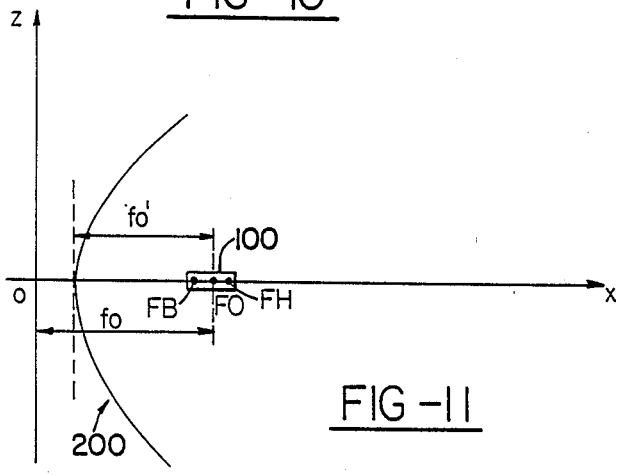
FIG. 11 is a diagrammatic longitudinal vertical section through the FIG. 10 reflector and through the filament of an associated lamp.
Figure 12:
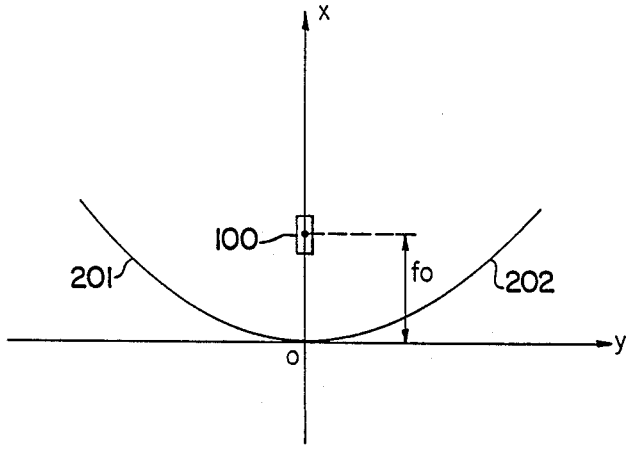
FIG. 12 is a diagrammatic horizontal section through the FIG. 11 assembly.

Reference is now made to FIGS. 10 to 12 to describe a variant embodiment of the invention. It is known that satisfactory recovery of the light flux emitted by a filament is directly related to the focal length $f_0$ of the reflector, which focal length must be as small as possible in practice.

In this variant, the surfaces 201 and 202 of the reflector shown in FIGS. 2 and 3 remain unchanged, i.e. they are sectors of paraboloids having focal length $f_0$. Their apexes are therefore situated at the above-defined point O, as shown in FIG. 12. However, the value of $\alpha$ is here of about 22.5°.

In contrast, the sectors 203' to 206' are defined by equations similar to those defining the sectors 203 to 206 of the first embodiment, except that $f_0$ is replaced therein by a value $f'_0$ which is smaller than $f_0$.

In order to ensure that the corresponding "focus" $F'_0$ always remains vertically over the center of the filament in the axial direction, it is clear that the common apex of the four sectors 203' to 206' can be no longer be situated at the point O, but must be situated somewhat between the point O and the center of the filament, as shown in FIG. 11.

It will be understood that this gives rise to a first order discontinuity between the sectors 201 and 202 and the other sectors, which discontinuity is represented in FIG. 10 by shading in different directions, along generator lines having respective slopes of $\alpha$ and $-\alpha$.

Thus, the surfaces 203' to 206' which are closer to the filament 100 provide better light recovery while still retaining their filament image distribution characteristics as described above, said characteristics being determined by the above-defined equations for sectors 203, 204 and 205, 206 respectively, independently of the value of $f_0$.

Further, the focal length $f_0$, greater than $f'_0$, of the paraboloids 201 and 202 serves to increase the aperture of the reflector without increasing its depth, thereby increasing the light intensity on the road axis.

This is shown in FIG. 10 by the outward side extensions of the sectors 201 and 202.

Naturally, the present invention is not limited to the above-described embodiments and any variant or modification occuring to the person skilled in the art may fall within the scope of the claims.

In particular, no account is taken in the above description of European standards which cause the right-hand half of a dipped beam cutoff to follow a half plane at an angle of 15° to the horizontal, whereas the bottom cutoff described for the additional headlight above is essentially horizontal over its entire width.

If it appears that there is excessive illumination in the overlap zone (the right-hand zone in the range 0° to 15°), the person skilled in the art can make modifications, in particular to the closure glass, in order to reduce said excess intensity.

Finally, the additional headlight in accordance with the invention could also be used in associated with dipped beam headlights having any other form of cutoff, so long as said cutoff is generally horizontal.

I claim:

1. A motor vehicle headlight suitable for emitting a light beam which is essentially complementary to a dipped beam having a cutoff so that together the two beams constitute a main beam, the headlight comprising an axial filament lamp, a reflector and a closure glass, the headlight including the improvements whereby:

the filament of the lamp emits freely in all directions thereabout;

the reflector comprises two first sectors which are paraboloid in shape, which have a common focus situated approximately in the middle (in the axial direction) of the filament and a common axis of revolution which defines the axis of the headlight, said first sectors being delimited by half-planes that are inclined on either side of substantially horizontal plane passing through the axis of the headlight in order to create a spot of light concentration in the vicinity of said headlight axis, and two other sectors which interconnect said first sectors with continuity and which are shaped such that the major part of each filament image produced thereby lies above a cutoff that substantially coincides with the cutoff of the dipped beam; and certain zones of the closure glass include means for distributing the beam horizontally.

2. A headlight according to claim 1, wherein the filament is cylindrical in shape and wherein the filament axis lies along said headlight axis.

3. A headlight according to claim 1, wherein said other sectors are defined by the following equations:

$$x = \frac{(y\cos\alpha + z(y/|y|)\sin\alpha)^2}{4f_0} + \frac{(z\cos\alpha - |y|\sin\alpha)^2}{4(f_0 + \Delta f_H/P)}$$

with:

$$P = 1 + \frac{(y\cos\alpha + z(y/|y|)\sin\alpha)^2}{4f_0^2}$$

for sectors situated in the upper half of the reflector, and:

$$x = \frac{(y\cos\alpha - z(y/|y|)\sin\alpha)^2}{4f_0} + \frac{(-z\cos\alpha - |y|\sin\alpha)^2}{4(f_0 - \Delta f_B/Q)}$$

with:

$$Q = 1 + \frac{(y\cos\alpha - z(y/|y|)\sin\alpha)^2}{4f_0^2}$$

for the sectors situated in the lower half of the reflector, where:

$\alpha$ is the angle of inclination relative to the horizontal of the planes which delimit the first sectors;

$\Delta f_H$ and $\Delta f_B$ are parameters which determine the extent to which the images are raised above said cutoff; and $f_0$ is the focal length of said first sectors which are paraboloid in shape.

4. A headlight according to claim 3, wherein the parameters $\Delta f_H$ and $\Delta f_B$ have values which are less than one half of the length of the filament.

5. A headlight according to claim 4, wherein the regions of the closure glass corresponding to said first two sectors of the reflector deflect light little, if at all.

6. An assembly comprising a dipped beam headlight and an additional headlight, said headlights respectively emitting a dipped beam and a beam which is complementary to said dipped beam, said two beams together constituting a main beam, said additional headlight being a headlight according to claim 5.

* * * * *